US005329857A

United States Patent [19]

Owens

[11] Patent Number: 5,329,857

[45] Date of Patent: Jul. 19, 1994

[54] TRACK SWITCH FOR SUSPENDED MOVABLE WALL PANELS

[75] Inventor: N. Douglas Owens, Lynn, Ind.

[73] Assignee: Modernfold, Inc., New Castle, Ind.

[21] Appl. No.: 994,881

[22] Filed: Dec. 22, 1992

[51] Int. Cl.[5] ..... E01B 25/26

[52] U.S. Cl. ..... 104/103; 104/130

[58] Field of Search ..... 104/96, 103, 195, 130 X; 246/262, 263, 415 R, 416, 434

[56] References Cited

U.S. PATENT DOCUMENTS

| | | | |
|---|---|---|---|
| 3,340,822 | 9/1967 | Delasalle | 104/130 |
| 3,418,944 | 12/1968 | Hansford et al. | 104/130 |
| 3,474,738 | 4/1967 | Di Rosa | 104/130 |
| 3,769,915 | 11/1973 | Swartz | 104/130 |
| 4,089,270 | 5/1978 | Blake | 104/130 |
| 4,229,857 | 10/1980 | Toder | 16/95 R |
| 4,336,757 | 6/1982 | Toder | 104/102 |
| 4,555,828 | 12/1985 | Matimura | 16/95 R |
| 4,642,947 | 2/1987 | Dickson | 62/64 |
| 4,880,046 | 11/1989 | Gesy | 160/194 |
| 4,924,776 | 5/1990 | Uttscheid | 104/130 |
| 5,016,318 | 5/1991 | Harris | 16/95 R |
| 5,033,394 | 7/1991 | Summa | 104/130 X |

FOREIGN PATENT DOCUMENTS

| | | | |
|---|---|---|---|
| 477599 | 10/1969 | Switzerland | 104/130 |
| 1465372 | 3/1989 | U.S.S.R. | 104/103 |

OTHER PUBLICATIONS

Modernfold, Inc., Operable Walls, Portable Panels, Accordion Partitions (product brochure), 1991, (see p. 27 for track switches).

*Primary Examiner*—Robert J. Oberleitner
*Assistant Examiner*—S. Joseph Morano
*Attorney, Agent, or Firm*—Baker & Daniels

[57] ABSTRACT

A track switch for use with a track intersection for movable wall panels wherein the track intersection has a first track path and a second track path for the movable wall panels to traverse. The switch includes an actuator movable between a first actuator position and a second actuator position upon actuation by a power source. The switch also includes a diverter operatively connected to the actuator and selectively movable between a first diverter position defining the first track path and a second diverter position defining a second track path. Movement of the actuator between the first and second actuator positions causes the diverter to move between the first and second diverter positions, respectively. The actuator includes a biasing mechanism for biasing the diverter toward the selected diverter position. The biasing mechanism is operatively connected to the diverter such that, as the diverter is in or moving toward the selected diverter position, the biasing mechanism allows the diverter to move toward the non-selected diverter position upon application of a force against the diverter toward the non-selected diverter position.

9 Claims, 7 Drawing Sheets

TRACK SWITCH FOR SUSPENDED MOVABLE WALL PANELS

BACKGROUND OF THE INVENTION

1. Field of the Invention

This invention relates to movable wall panels used to divide large rooms into smaller rooms, and, in particular, to a switch for intersecting tracks for such movable wall panels.

2. Description of the Related Art

Movable wall panel systems are used to divide large areas into smaller areas or rooms. Typically, wall panels are suspended by trolleys from a track which resides within the room's suspended ceiling so that the track system does not interfere with the room's aesthetic appearance. Many installations required the flexibility to either stack the panels in alternate positions and/or to move the walls to form different wall panel configurations.

An example of a track intersection for wall panels having multiple paths through which the panels may travel is disclosed in U.S. Pat. No. 4,555,828. Each wall panel includes a retainer which corresponds in height to one of the guide rails of a guide plate placed at the track's intersection. Thus, specific panels are set up to move in a particular direction at the intersection. Similarly, U.S. Pat. No. 5,016,318 discloses a track intersection having diverter blades which are engaged by diverter pins connected to the wall panel's trolley to make certain that a particular wall panel moves through the intersection in a proscribed direction. The guiding systems of U.S. Pat. Nos. 4,555,828 and 5,016,318 do not provide the user the flexibility to move panels in any direction once it reaches the intersection as no mechanism is provided to select the desired track direction once the retainer height or diverter pin placement has been established. Thus, it is desirable to provide a switch which allows each wall panel to move through the intersection in any direction without requiring modification of the trolley from which the panel is suspended.

Selectable track switches are available in a variety of configurations. For example, U.S. Pat. No. 4,336,757 discloses a manually actuated track switch which permits a curtain suspending from the track to be moved through a track intersection in one of two available directions, depending on the position of the switch. Specifically, the track intersection includes a slider switch which is movable between two positions. Essentially, the switch moves a preformed track portion to direct the curtain through the selected track path. If implemented for a movable wall panel system, the switch of U.S. Pat. No. 4,336,757 may be utilized to choose a path over which the panels are to travel; however, should the switch be activated when a wall panel trolley or other obstruction is positioned such that the obstruction impedes the movement of the movable track portion, damage to the switch may result. Therefore, it is desirable to provide a track switch which is not damaged should the switch be activated in the presence of such an obstruction. Also, should a wall panel be positioned on that portion of the track not selected and the panel be moved into the track intersection, the wall panel is stopped by the switch which may either damage the switch or the wall panel trolley.

Rotary switches are utilized in the track system of U.S. Pat. No. 4,642,947 to permit wall panels to be moved from a primary track onto a set of storage tracks which are parallel to the main path over which the panels traverse. This invention does not provide a means for selecting the path direction, but rather provides a means for moving panels from a selected path into a stored position.

Track switching devices have been developed for tracks located within the floor such as may be desirable for an air-cushioned vehicle. A manual switch is disclosed in U.S. Pat. No. 3,340,822, for example, to allow the operator of a vehicle to actuate a switch located on the vehicle to choose the path direction through the track intersection. Such an approach is inefficient when considered for use with movable wall panels suspended from a track located in the ceiling as many successive panels are likely to be moved along the same path to form a wall on that path's track. It is preferable, therefore, to provide a switch affecting the track intersection rather than requiring that a switch on each panel be actuated.

An electrically actuated switch for a track located within the floor is illustrated in U.S. Pat. No. 4,924,776. In this system, a guide pin comprised of electromagnetic material is disposed on the front of the vehicle and electromagnetic devices are located proximate the track intersection such that actuation of certain electromagnetic devices attracts the vehicle's guide pin toward a particular path. If implemented for a movable wall panel system suspended from a track in the ceiling wherein each panel is of substantial weight, such a switching mechanism requires that some portion of the panel's trolley be composed of an electromagnetic material—an undesirable expense—and also requires that significant power to be supplied to the track's electromagnetic devices to move the heavy wall panels. It is desirable to provide an electrically actuated track switch for movable wall panels which is inexpensive to manufacture and to maintain.

Various movable wall panel manufacturers provide to its customers an electrically actuated track switch similar to the track switch disclosed in U.S. Pat. No. 4,336,757. Specifically, power is provided to move a movable track portion between selectable positions. Once a wall panel has moved forward through the track intersection wherein a single track path branches into two or more track paths, these track switches require that a user change the switch position in order to move a wall panel back through the track intersection. If the user does not change the switch position prior to moving the panels "backward" through the intersection, significant damage to the switch may result. The switch may be rendered inoperable and significant repair costs may be incurred. It is desirable to provide a track switch which will not be damaged if a panel is moved against the directions established by the switch.

Additionally, existing track switches are only operable when the switch it clear, i.e., when no portion of the wall panel, such as the trolley and dollies from which the panels are suspended from the track, obstructs the switch. If such an obstruction occurs, the switch may be damaged. Therefore, it is desirable to provide an electrically actuated track switch which is not damaged in the event the switch is obstructed by a trolley in the track proximate the switch.

SUMMARY OF THE INVENTION

The present invention provides a track switch for use with a track intersection for movable wall panels suspended from the track wherein the track intersection has a first track path and a second track path through which the movable wall panels may be guided. The invention comprises, in one form thereof, a track switch including an actuator movable between a first actuator position and a second actuator position. The switch also includes a diverter operatively connected to the actuator such that the diverter is selectively movable between a first diverter position, defining the first track path, and a second diverter position, defining a second track path. Movement of the actuator between the first and second actuator positions causes the diverter to move between the first and second diverter positions, respectively. The actuator of the present invention includes a bias means for biasing the diverter toward the selected diverter position. The bias means is operatively connected to the diverter such that, as the diverter is in or moving toward the selected diverter position, the bias means allows the diverter to move toward the non-selected diverter position upon application of a force against the diverter toward the non-selected diverter position. The bias means of the actuator is structured and arranged to permit the application of such a force without resulting in the application of a load to the power source.

The track switch of the present invention may also include a motor operatively connected to the actuator and a control means for controlling the position of the diverter, the control means including a means for selecting the diverter position. First and second limit switches connected to the control means may be provided together with first and second limit switch actuator arms connected to the bias means such that when the actuator is in the first actuator position, the first limit switch actuator engages the first limit switch and when the actuator is in the second actuator position, the second limit switch actuator arm engages the second limit switch. The first and second limit switches are electrically connected to the control means to provide feedback to the control means indicating that the selected diverter position has been reached such that power to the motor is disconnected.

In another embodiment thereof, the invention comprises a track switching system for movable wall panels including the track switch as described as well as a track intersection having a first track path and a second track path.

An advantage of the invention is the provision of a track switch for movable wall panels which will not be damaged should a panel be moved against the direction established by the switch.

Another advantage of the invention is the provision of an electrically powered track switch for movable wall panels which will not be damaged when obstructed by a trolley in the track proximate the switch.

Yet another advantage of the invention is the provision of an electrically actuated track switch which is less expensive to manufacture and maintain than those currently used in the industry.

Still another advantage of the invention is the provision of an electrically actuated track switch for movable wall panels which supports multiple paths of the panels.

Another advantage of the present invention is the provision of a track switch which does not require modification of the trolley from which a wall panel is suspended to select the track path over which that wall panel is to traverse.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION

Figure 1:
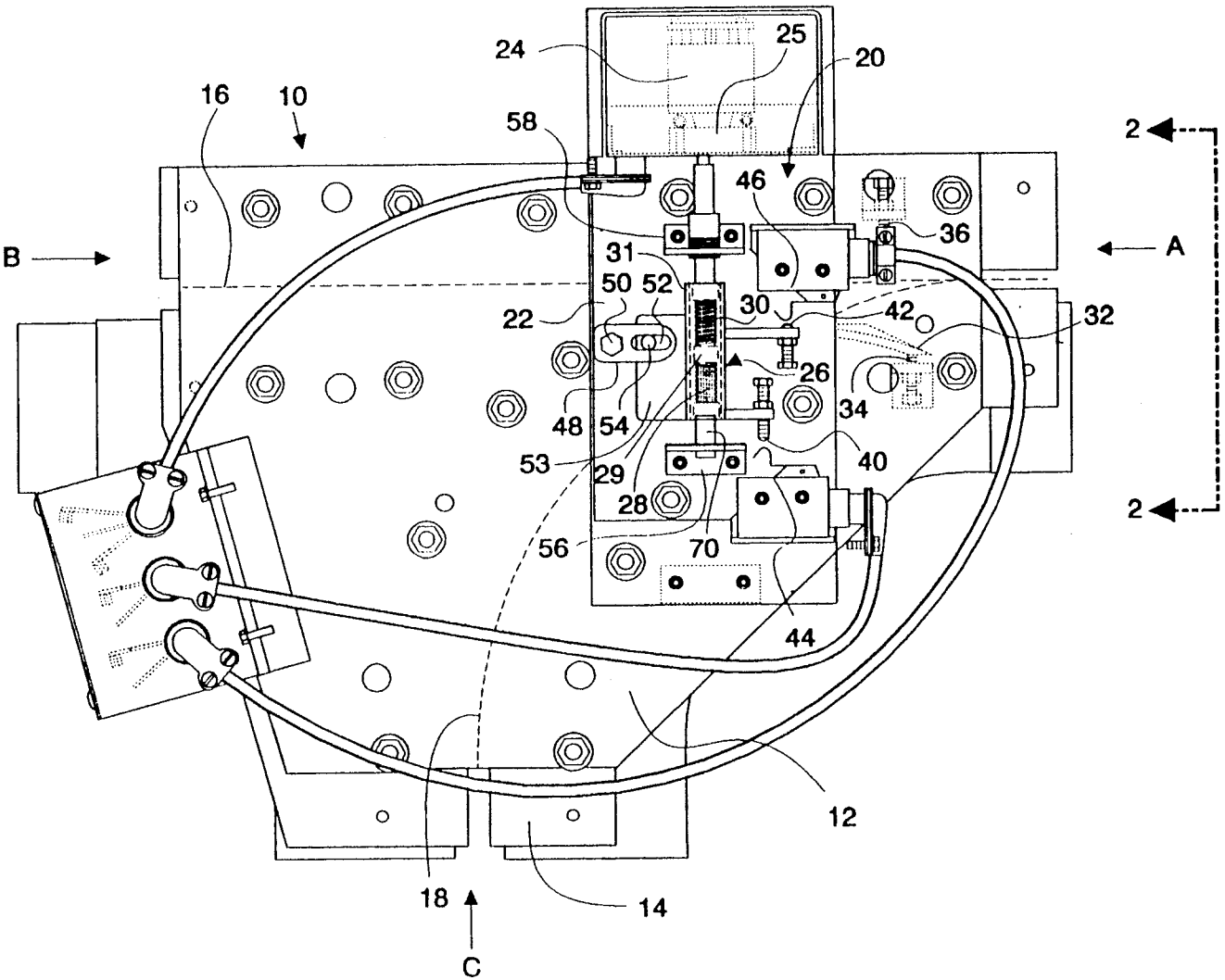
FIG. 1 shows a top view of one embodiment of the track switch for movable wall panels of the present invention.

Referring now to FIG. 1, there is shown a top view of one embodiment of the track switch for movable wall panels of the present invention. In this embodiment, track intersection 10 includes top plate 12 and bottom plate 14. Bottom plate 14 defines first track path 16 and second track path 18 through which movable wall panels suspended from track intersection 10 are to move. Attached to top plate 12 is track switch 20. In this embodiment, all elements of track switch 20 are operatively connected to track switch bracket 22. Track switch 20 includes a suitable power source, shown here as motor 24. Motor 24 is operatively connected to actuator 26 through gear box 25 (see FIGS. 2A and 5) and rotatable rod 70. Rod 70 has a longitudinal axis extending through first support bracket 56 and second support bracket 58 such that rod 70 is able to rotate about is longitudinal axis, but is unable to advance in the direction of its longitudinal axis between first and second support brackets 56 and 58. Rod 70 also has a threaded portion proximate first support bracket 56 and, in this embodiment, encompassing approximately half of the length of rod 70. Actuator 26 includes square tube 31 disposed about the threaded portion of rod 70, within square tube 31 and threadably engaging rod 70, and first and second compression springs 28 and 30, respectively, within square tube 31 and about rod 70. In addition, actuator 26 includes actuator plate 53 connected to square tube 31 and having protrusion 54 extending therefrom for engaging slot 52 of actuator arm 48. Diverter 32, positioned below track intersection top plate 12 and above track intersection bottom plate 14, in this embodiment is connected to actuator arm 48 via diverter rod 50. Actuator arm 48 pivots about a pivot point corresponding to the center of diverter rod 50. In this embodiment, actuator 26 also includes first and second limit switch actuating arms 40 and 42 for engaging first and second limit switches 44 and 46, respectively, as actuator 26 moves. The operation of track switch 20, including actuator 26, will be described in further detail herein.

Figure 2B:
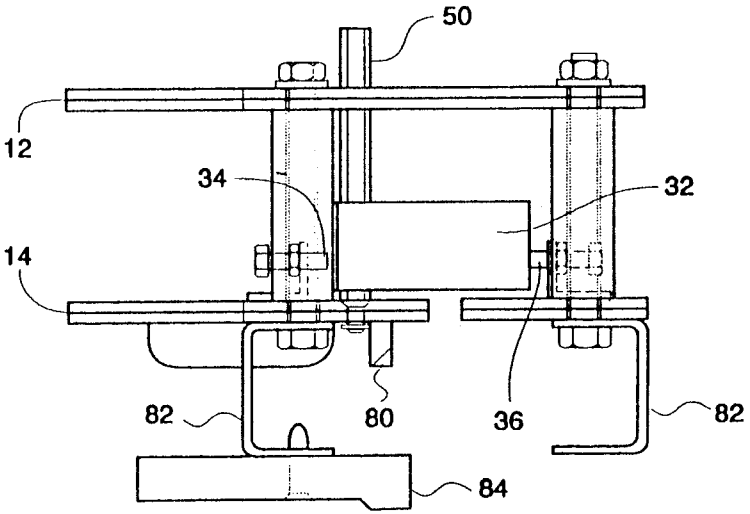
FIG. 2B shows a side view of the track switch of the embodiment of FIG. 1 wherein the diverter is positioned to guide a wall panel moving into the track intersection to move along the curved path.
Figure 2A:
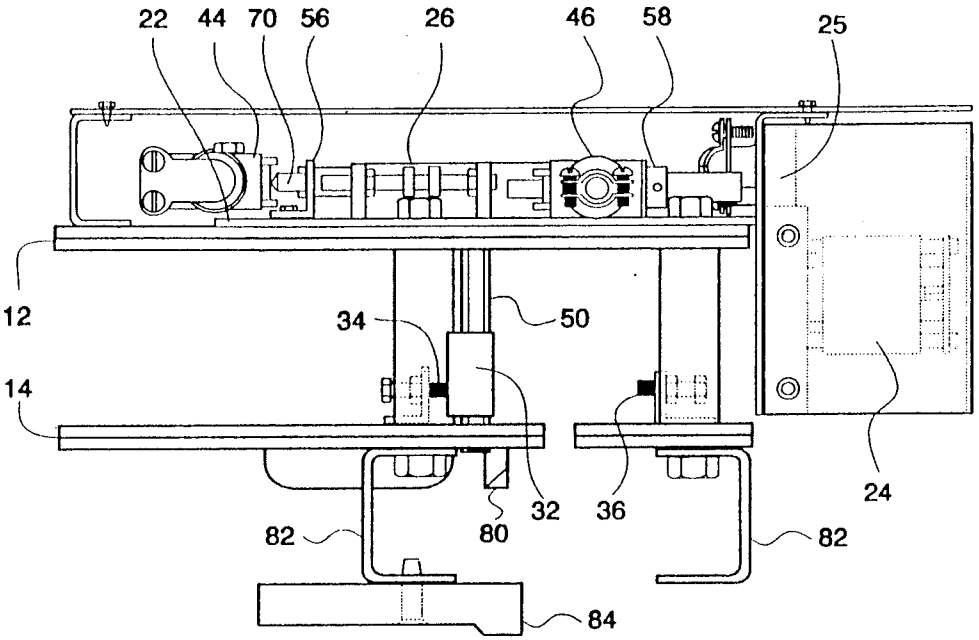
FIG. 2A shows a side view of the track switch of the embodiment of FIG. 1 wherein the diverter is positioned to guide a wall panel moving into the track intersection to move along a straight path.

To provide a better understanding of the operation of the track switch of the present invention, FIGS. 2A–8 show the track switch of FIG. 1 in greater detail. Referring first to FIGS. 2A and 2B, there are shown side views of the track switch of the embodiment of FIG. 1 wherein the diverter is positioned to guide a wall panel moving into the track intersection to move along a straight path and wherein the diverter is positioned to guide a wall panel moving into the track intersection to move along the curved path, respectively. In this embodiment, soffit bracket 82 is affixed above soffit 84 and soffit bracket 82 is affixed to bottom plate 14. Soffit bracket 82 and soffit 84 are both optional. Also, in this embodiment, top and bottom plates 12 and 14 are each comprised of two sub-plates. Such construction of top and bottom plates 12 and 14 provides additional stability to track intersection 10 as may be desirable for installations in which tall, heavy wall panels are supported by track intersection 10, but is not essential to the invention. In FIG. 2A, diverter 32 engages first diverter stop 34 to direct a movable wall panel moving in direction A to move through first track path 16 (see FIG. 3A) when approaching track intersection 10 (see FIG. 1). In FIG. 2B, diverter 32 engages second diverter stop 36 to direct a movable wall panel moving in direction A to move through second track path 18 (see FIG. 3B) when approaching track intersection 10 (see FIG. 1).

Figure 3B:
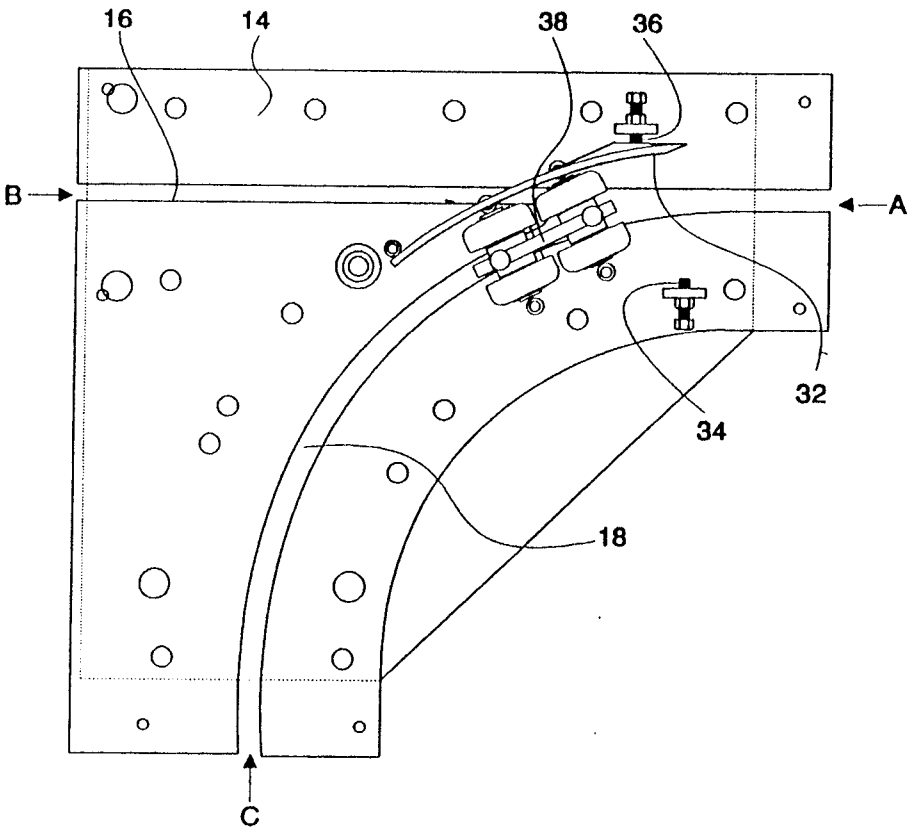
FIG. 3B shows a top view of the lower portion of the track switch of the embodiment of FIG. 1 wherein the diverter is positioned to direct the trolley of a movable wall panel to move along the curved track path.
Figure 3A:
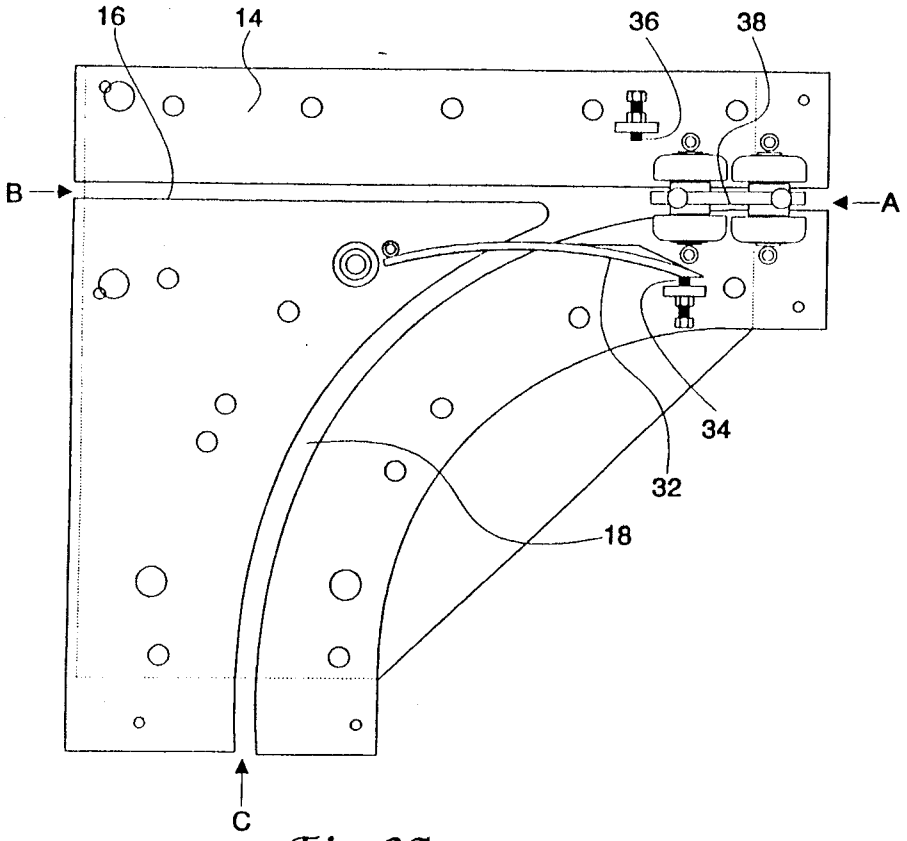
FIG. 3A shows a top view of the lower portion of the track switch of the embodiment of FIG. 1 wherein the diverter is positioned to direct the trolley of a movable wall panel to move along the straight track path.

Referring now to FIGS. 3A and 3B, there are shown top views of the lower portion of the track switch of the embodiment of FIG. 1 illustrating the positions of the diverter with respect to the paths that may be taken by the wall panel trolley. In FIG. 3A, as in FIG. 2A, diverter 32 engages first diverter stop 34 to guide trolley 38 along first track path 16, which in this embodiment is a straight path, when trolley 38 is moving into track intersection 10 in direction A. In FIG. 3B, as in FIG. 2B, diverter 32 engages second diverter stop 36 to guide trolley 38 along second track path 18, which in this embodiment is curved, when trolley 38 is moving into track intersection 10 in direction A.

Figure 4B:
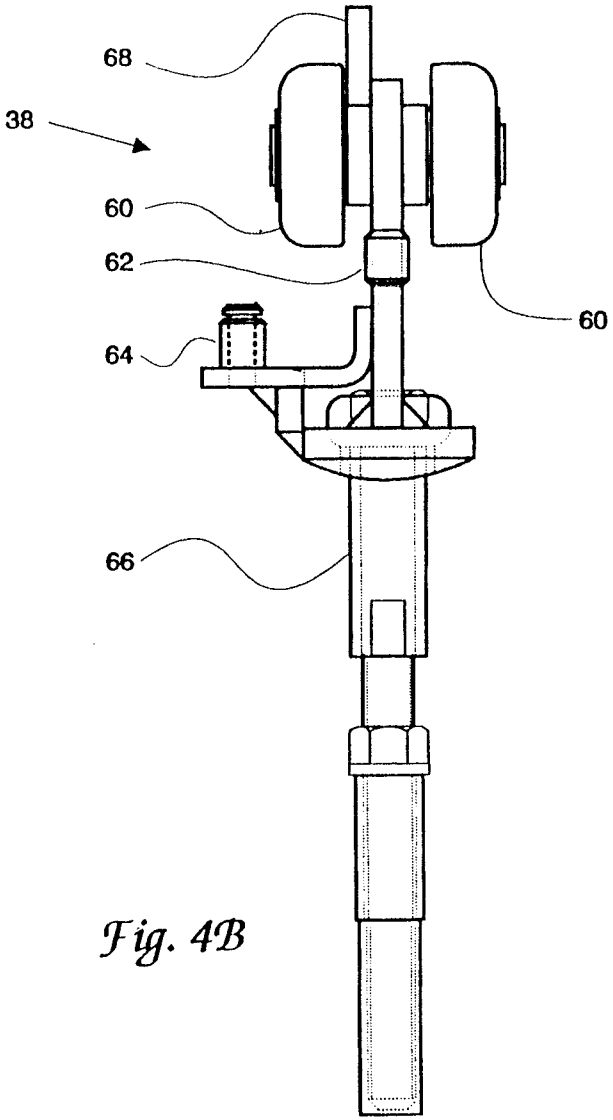
FIGS. 4A and 4B show a side view and a front view, respectively, of one embodiment of the trolley of a wall panel which may be utilized with the track switch of the present invention.
Figure 4A:
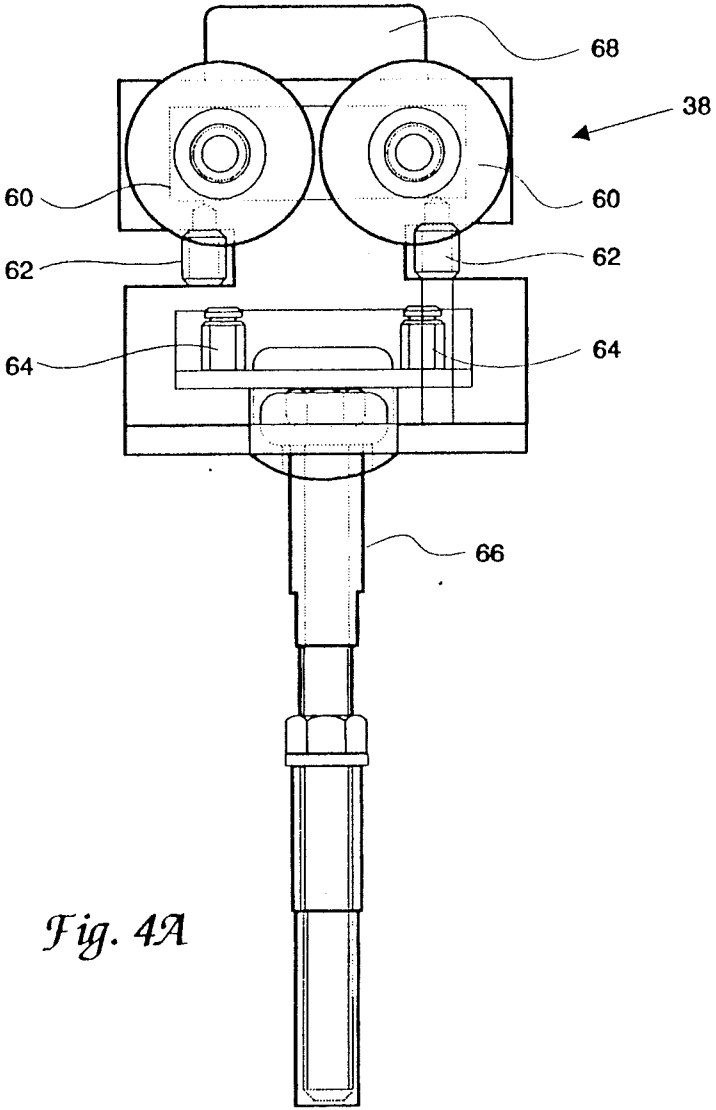

FIGS. 4A and 4B show a side view and a front view, respectively, of one embodiment of the trolley of a wall panel which may be utilized with the track switch of the present invention. Trolley 38 includes wheels 60 which ride on bottom plate 14 of track intersection 10. Trolley 38 also includes first guide bushings 62 which guide trolley 38 within either first track path 16 or second track path 18. In this embodiment, trolley 38 also includes second guide bushings 64 and trolley guide 68 as trolley 38 may also be used in conjunction with a manual track switch wherein second guide bushings 64 and trolley guide 68 engage diverters rigidly affixed to a manual switch track intersection. Second guide bushings 64 and trolley guide 68 are not essential for use of trolley 38 with the electric track switch disclosed herein. A movable wall panel, not shown, is attached to trolley shaft 66 such that the wall panel is suspended from trolley 38 and resides below soffit 84.

Figure 5:
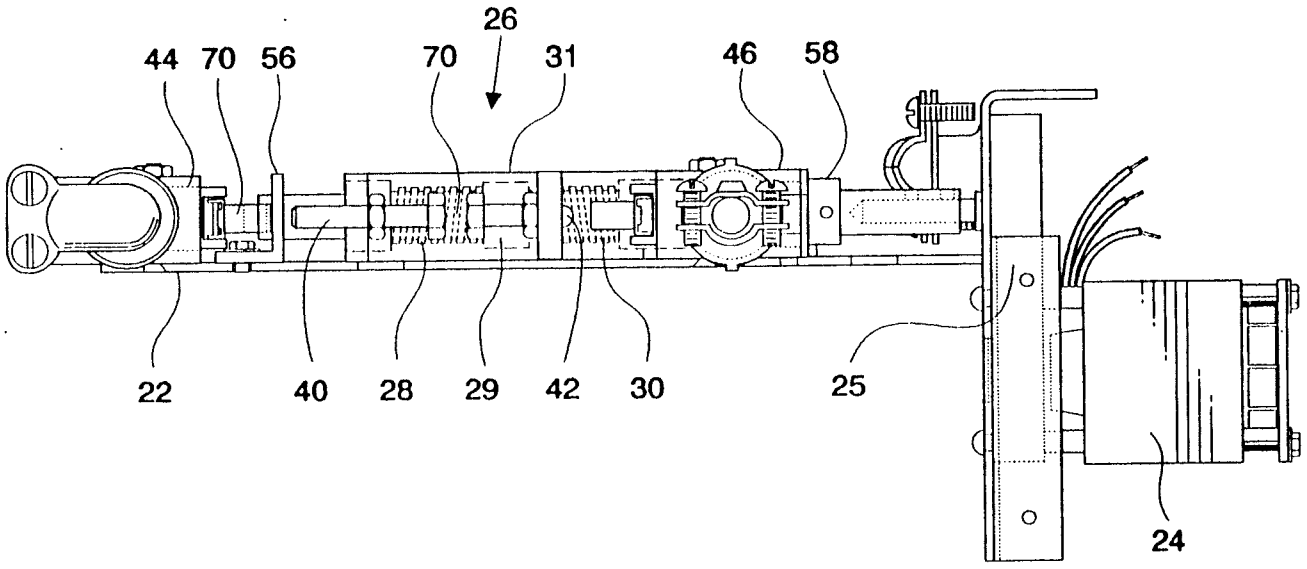
FIG. 5 shows a side view of the electric motor and actuator of one embodiment of the track switch of the present invention.

Referring now to FIG. 5, there is shown a side view of the electric motor and actuator of one embodiment of the track switch of the present invention. Rod 70 extends through both first and second support brackets 56 and 58, respectively, and is operatively connected to motor 24 via gear box 25 such that provision of power to motor 24 causes gear box 25 to rotate rod 70 about the longitudinal axis of rod 70. Disposed about the threaded portion of rod 70 are first and second compression springs 28 and 30, respectively. First and second compression springs 28 and 30 are also disposed within square tube 31 such that first and second compression springs 28 and 30 advance with the advancement of square tube 31 along the longitudinal axis of rod 70 as described in further detail below.

During operating of track switch 20 as shown in FIGS. 1 and 5, the provision of power to reversible motor 24, through gear box 25, causes rod 70 to rotate about its longitudinal axis between first support bracket 56 and second support bracket 58. Specifically, in this embodiment, as rod 70 is rotated in a clockwise direction (as viewed from the side of second bracket 58 closest to motor 24), square nut 29, being incapable of rotating with rod 70 due to its disposition within square tube 31, moves along the longitudinal axis of rod 70 toward first bracket 56 until first limit switch actuating arm 40 engages first limit switch 44. When first limit switch actuating arm 40 engages first limit switch 44, actuator 26 is in the first actuator position and power to motor 24 is disconnected. The movement of square tube 31 in the direction of the longitudinal axis of rod 70 causes the clockwise rotation of actuator arm 48 about its pivot point as protrusion 54, extending from actuator plate 53 which is rigidly affixed to square tube 31, engages slot 52 of actuator arm 48. The clockwise rotation of actuator arm 48 causes diverter 32 to engage first stop 34 at which point diverter 32 has reached the first diverter position to thereby influence a trolley entering track intersection 10 in direction A to move through first track path 16 as illustrated in FIGS. 2A and 3A. Specifically, as trolley 38 enters track intersection 10 in direction A and diverter 32 is in the first diverter position as illustrated in FIG. 3A, diverter 32 prevents trolley 38 from transversing the curved path and allows trolley 38 to move along the straight path which trolley 38 is naturally inclined to traverse.

When rod 70 is rotated in a counterclockwise direction, nut 29 moves along the longitudinal axis of rod 70 toward second bracket 58 until second limit switch actuating arm 42 engages second limit switch 46. When second limit switch actuating arm 42 engages second limit switch 46, actuator 26 is in the second actuator position and power supplied to motor 24 is disconnected. The movement of square tube 31 with respect to the longitudinal axis of rod 70 causes the counterclockwise rotation of actuator arm 48 about its pivot point at the center of diverter rod 50 to cause diverter rod 50 to rotate diverter 32 to engage second stop 36, at which point diverter 32 has reached the second diverter position, influencing a trolley entering track intersection 10 in direction A to move through second track path 18 as illustrated in FIGS. 2B and 3B. Specifically, as trolley 38 enters track intersection 10 in direction A and diverter 32 is in the second diverter position as illustrated in FIG. 3B, wheels 60 of trolley 38 engage diverter 32 to guide trolley 38 through the curved path.

It will be appreciated by those of skill in the art that the presence of first and second compression springs 28 and 30, respectively, are not instrumental in the movement of diverter 32 to the first and second diverter positions. Rather, first and second compressions springs 28 and 30 serve as a means for biasing diverter 32 toward the first diverter position and the second diverter position, respectively. Also, as diverter 32 is in or moving toward a selected diverter position, i.e., either the first or second diverter position, the bias means allows diverter 32 to move toward the non-selected diverter position upon application of a force against diverter 32 toward the non-selected diverter position. Further, first or second compression springs 28 or 30 allow such force to be applied against the selected position of diverter 32 without affecting the rotation of rod 70. Thus, should a trolley from which a wall panel suspends reside on either the first or second track paths beyond diverter 32, movement of the trolley in directions B or C against diverter 32 permits diverter 32 to be pivoted toward the other track direction, i.e., the other diverter position. Thus, diverter 32 may be pushed out of the way by a trolley attempting to traverse against diverter 32. Though pushing diverter 32 exerts a force along the longitudinal axis of rod 70, such longitudinal force is absorbed by second bracket 58 as rod 70 is not permitted to move longitudinally with respect to second bracket 58. Further, pushing diverter 32 does not place a rotational force directly on rod 70 and as a consequence, no load is applied to motor 24 should a force be applied against diverter 32 toward the non-selected diverter position as the diverter is moving toward the selected position.

It will be further appreciated that the presence of first and second compression springs 28 and 30 prevents destruction of the switch when an object obstructs that portion of track intersection 10 over which diverter 32 passes. Because diverter 32 is not rigidly affixed to rod 70 which is in turn affixed to motor 24, motor 24 does not burn out upon selection of a desired track path position of diverter 32 when such an obstruction exists. Rather, rod 70 continues to rotate until the obstruction has been removed or motor 24 has been turned off by actuation of either first or second limit switch 44 or 46, respectively. As a result, repair costs are minimized in the event a user inadvertently places an obstruction such as a trolley in the path of diverter 32 when selecting a path direction as no appreciable load is placed on motor 24 when diverter 32 is unable to move between its prescribed positions by the presence of such an obstruction.

Figure 6:
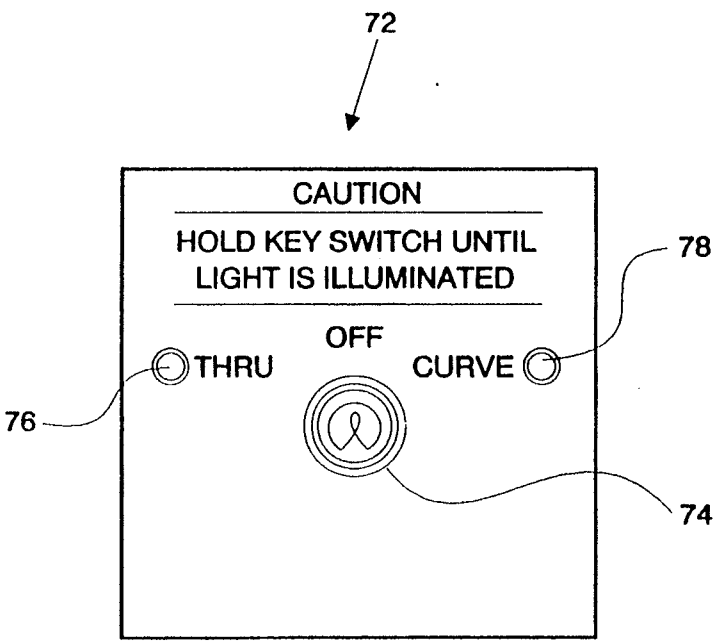
FIG. 6 shows a front view of one embodiment of the electronic key switch control used to select the desired track path via the track switch according to the present invention.

FIG. 6 shows a front view of one embodiment of the electronic key switch control used to select the desired track path via the track switch according to the present invention. Control 72 includes momentary spring return key switch 74, such as model number 800T-J631A available from Allen Bradley, and THRU or first path indicator light 76 and CURVE or second path indicator light 78. In this embodiment, first path indicator light 76 comprises a yellow, 125 V AC neon light such as part number 2150A3 available from Industrial Devices, and second path indicator light 78 comprises a green, 125 V AC neon light such as part number 2152A5 available from Industrial Devices. To operate control 72, key switch 74 is turned toward either first path indicator light 76 or second path indicator light 78. Key switch remains in the desired postion until the appropriate indicator light is illuminated, indicating that diverter 32 of track switch 20 has reached the proper position as illustrated in FIGS. 2A and 3A or in FIGS. 2B and 3B, for the THRU or CURVE selections, respectively. Once either first or second indicator light 76 or 78, respectively is illuminated, key switch 74 may be returned to the OFF position as no further actuation of track switch 20 is necessary.

Figure 8:
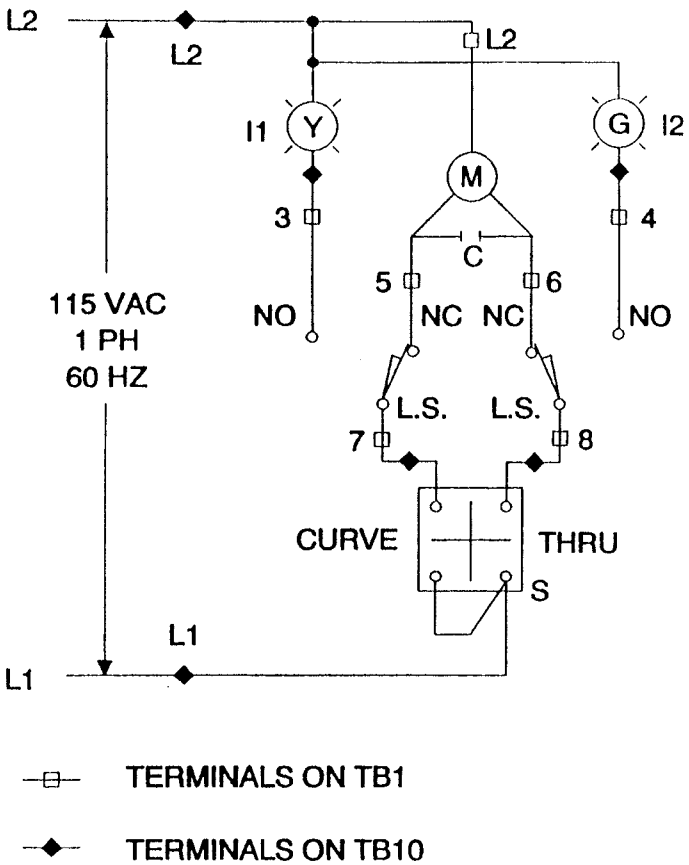
FIG. 8 shows another schematic diagram of the electronic circuitry of the embodiment of FIGS. 6–7.
Figure 7:
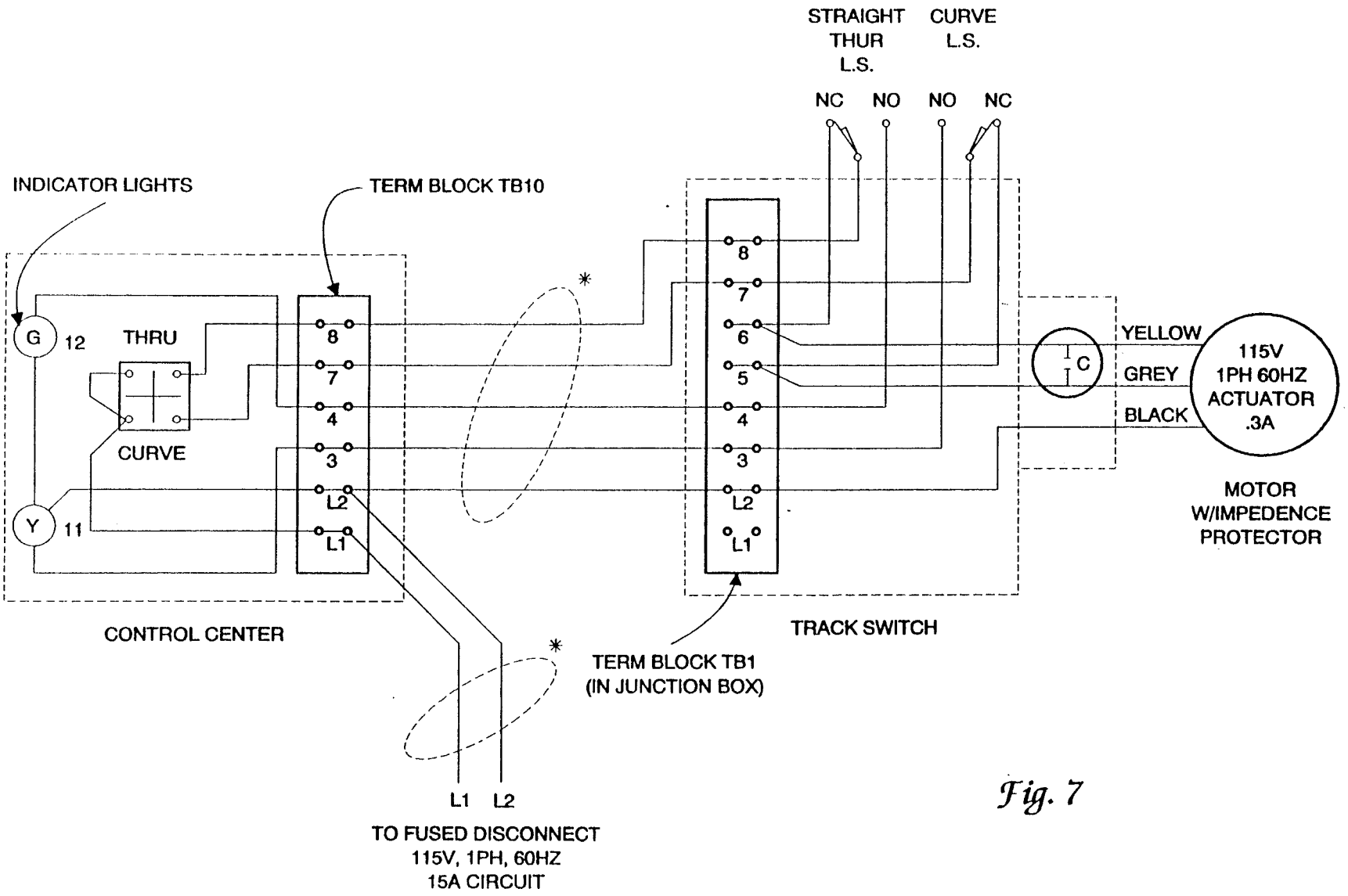
FIG. 7 shows a schematic diagram of one embodiment of the electronic control system used to actuate the track switch of the present invention.

It will be appreciated by those of skill in the art that should an obstruction prohibit the movement of the diverter between the first and second diverter positions, the appropriate indicator light will not illuminate as the actuator has not yet tripped a limit switch (see FIGS. 7–8). The lack of such illumination should alert the operator that an obstruction is present. Optionally, it may be desirable to place implement a timer circuit within the control which sounds an alarm or illuminates a warning light in the event the selected position of the diverter is not achieved within a reasonable amount of time.

FIG. 7 shows a schematic diagram of one embodiment of the electronic control system used to actuate the track switch of the present invention. The components of this circuit are of the type that are readily available from most distributors. For example, first and second limit switches 44 and 46 are available from a variety of sources, including part number BZ-2RW80147-A2 available from Micro-Switch, a division of Honeywell. Motor 24 is a reversible AC motor such as the Dayton Model 2Z829 (60 rpm with impedance protector). The capacitor in this embodiment is part number 97F5704BX available from General Electric, and terminal blocks TB1 and TB10 may comprise part numbers 1492-N1 and 1492-F2, respectively, available from Allen Bradley. The CONTROL CENTER illustrated in this figure, is encased within control 72 illustrated in FIG. 6. Control 72 is connected to first and second limit switches 44 (L1) and 46 (L2), respectively, so that the proper indicator light may be illuminated once the track switch has reached the desired position. Control 72 also commands track switch 20 to activate motor 24 in one of the two directions available, depending on the position of key switch 74. If key switch 74 is placed in the OFF position, power to motor 24 is disconnected.

It will be appreciated by those of skill in the art that the circuitry illustrated in FIG. 7 is composed of few components and most of the circuit's components are readily available. In addition, a minimal amount of power is required to activate motor 24. Dayton motor model number 2Z829, for example, is only a 0.03 amp motor having a rating of 1/100 H.P., 7 inch/lbs. start torque and 4 inch/lbs. run torque. Thus, the electronic circuitry of the track switch according to the present invention is inexpensive to manufacture and inexpensive to maintain.

Referring to FIG. 8, there is shown another schematic diagram of the electronic circuitry of the embodiment of FIGS. 6–7. Should either L1, first limit switch 44, or L2, second limit switch 46, be activated during operation, the corresponding indicator light, first indicator light 76 or second indicator light 78 is illuminated. Should either first limit switch L1 or second limit switch L2 be activated or opened, motor 24 is deactivated. When key switch 74 is placed in the OFF position, power to limit switches L1 and L2, indicator lights 76 and 78, and motor 24 is disconnected.

It will be appreciated by those of skill in the art that the provision of lights displayed on the control unit permit the operator to be assured that the diverter is in the proper position before beginning to move wall panels through the track intersection.

What is claimed is:

1. A track switch for a movable wall panel track intersection having a first track path and a second track path, the switch comprising:

an actuator operatively connected to a power source and selectively movable between a first actuator position and a second actuator position upon actuation by the power source; and a diverter operatively connected to the actuator, the diverter being selectively movable between a first diverter position upon movement of the actuator to the first actuator position, and a second diverter position upon movement of the actuator to the second actuator position, the first diverter position defining the first track path of the track intersection and the second diverter position defining the second track path of the track intersection;

the actuator including a bias means for biasing the diverter toward the selected diverter position, the bias means being operatively connected to the diverter such that, as the diverter is in or moving toward the selected diverter position, the bias means allows the diverter to move toward the non-selected diverter position upon application of a force against the diverter toward the non-selected diverter position, and thereafter returned to the selected diverter position upon cessation of the force, and wherein the actuator is movable from a selected one of the first or second actuator positions to the other of the first or second actuator positions upon movement of the diverter toward the non-selected position upon application of the force, the actuator movable toward the non-selected actuator position independent of the power source.

2. The switch of claim 1 wherein the bias means of the actuator is structured and arranged such that the application of a force against the diverter toward the non-selected diverter position as the diverter is moving toward the selected diverter position does not result in the application of a load to the power source.

3. The switch of claim 1 in which the power source is a reversible motor, and the switch further comprises a rod having a longitudinal axis and operatively connected to the motor such that rotation of the rod about its longitudinal axis by the motor causes the actuator to move between the first and second actuator positions.

4. The switch of claim 3 wherein the bias means comprises first and second compression springs disposed about the actuator, one compression spring biasing the diverter toward the first diverter position and the second compression spring biasing the diverter toward the second diverter position.

5. The switch of claim 3, further comprising:

control means operatively connected to the motor, the control means controlling the position of the diverter and including a means for selecting the first and second diverter positions.

6. The switch of claim 5, further comprising:

first and second limit switches electrically connected to the control means; and first and second limit switch actuator arms connected to the bias means such that when the actuator is in the first actuator position, the first limit switch actuator arm engages the first limit switch, and such that when the actuator is in the second actuator position, the second limit switch actuator arm engages the second limit switch, such engagement of the first or second limit switches disconnecting power to the motor and providing feedback to the control means that the first or second diverter positions, respectively, have been reached.

7. The switch of claim 1 further comprising:

first stop means for engaging the diverter when the diverter is in the first diverter position; and second stop means for engaging the diverter when the diverter is in the second diverter position, wherein the first and second stop means are operatively connected to the track intersection.

8. A track switching system for movable wall panels, comprising:

a track intersection having a first track path and a second track path; and a track switch comprising:

an actuator movable between a first actuator position and a second actuator position upon actuation by a power source, a diverter operatively connected to the actuator, the diverter being selectively movable between a first diverter position upon movement of the actuator to the first actuator position, and a second diverter position upon movement of the actuator to the second actuator position, the first diverter position defining the first track path of the track intersection and the second diverter position defining the second track path of the track intersection, the actuator including a bias means for biasing the diverter toward the selected diverter position, the bias means operatively connected to the diverter such that, as the diverter is in or moving toward the selected diverter position, the bias means allows the diverter to move toward the non-selected diverter position upon application of a force against the diverter toward the non-selected diverter position, a motor operatively connected to the actuator and a control means operatively connected to the motor, the control means controlling the position of the diverter and including a means for selecting the first and second diverter positions, and first and second limit switches electrically connected to the control means, and wherein the actuator further comprises first and second limit switch actuator arms connected to the bias means such that when the actuator is in the first actuator position, the first limit switch actuator arm engages the first limit switch, and when the actuator is in the second actuator position, the second limit switch actuator arm engages the second limit switch, such engagement of the first or second limit switches disconnecting power to the motor and providing feedback to the control means that the first or second diverter positions, respectively, have been achieved.

9. The system of claim 8, further comprising a trolley capable of moving through the first and second track paths of the track intersection, the trolley being engaged by the diverter such that the position of the diverter directs the trolley through the track path direction defined by the diverter position.

* * * * *